US005204730A

United States Patent [19]

Richmond et al.

[11] Patent Number: 5,204,730

[45] Date of Patent: Apr. 20, 1993

[54] TRANSFER, DETAC POLARITY SWITCHING

[75] Inventors: David W. Richmond, Webster; Clifford K. Friend, Pittsford; Robert J. Mead, Hilton, all of N.Y.

[73] Assignee: Xerox Corporation, Stamford, Conn.

[21] Appl. No.: 891,097

[22] Filed: Jun. 1, 1992

[51] Int. Cl.[5] ..... G03G 15/01; G03G 15/14

[52] U.S. Cl. ..... 355/326; 355/274

[58] Field of Search ..... 355/326, 328, 271, 273, 355/274, 315; 430/42

[56] References Cited

U.S. PATENT DOCUMENTS

| | | | |
|---|---|---|---|
| 4,140,962 | 2/1979 | Quinn | 323/21 |
| 4,190,348 | 2/1980 | Friday . | |
| 4,627,703 | 12/1986 | Suzuki et al. . | |
| 4,714,978 | 12/1987 | Coleman | 361/235 |
| 4,791,528 | 12/1988 | Suzuki et al. | 361/235 |
| 4,868,608 | 9/1989 | Allen et al. . | |

FOREIGN PATENT DOCUMENTS

| | | |
|---|---|---|
| 58-184169 | 10/1983 | Japan . |
| 61-201281 | 9/1986 | Japan . |

*Primary Examiner*—R. L. Moses

*Attorney, Agent, or Firm*—Ronald F. Chapuran

[57] ABSTRACT

Method and apparatus for providing multiple colors in a single pass of a copy sheet through a transfer station by switching the polarity of a transfer corotron and automatically adjusting the output of the detac corona device. In particular, a single power supply including high voltage switches responds to color selections to change the polarity of a transfer corotron to charge a copy sheet for toner transfer, and a current sense and precision rectifier stage responds to the copy sheet charge to provide a suitable detac charge independent of the transfer corotron polarity.

9 Claims, 4 Drawing Sheets

TRANSFER, DETAC POLARITY SWITCHING

BACKGROUND OF THE INVENTION

This invention relates generally to methods and apparatus for transfer and detac polarity switching for rendering latent electrostatic images visible in systems having optional colors of dry toner or developer and, more particularly, to printing toner images in a single pass of the imaging surface through the processing areas of the printing apparatus upon operator selection among multiple highlighting colors by automatically adjusting transfer and detac corotron polarities in response to the operator selection.

Modern business and computer needs oftentimes make it advantageous and desirable to reproduce multi color originals into copies that contain colors selected from a plurality of highlight colors.

Several useful methods are known for making copies having highlight colors. Various techniques for controlling and switching transfer and detac corotrons are also well known. For example, U.S. Pat. No. 4,190,962 to Friday, assigned to Xerox Corporation, describes an apparatus and process by which higher transfer efficiencies and better image transfer can be achieved for the lead edge of a copy sheet. Increased transfer charge is applied to the lead edge area of the copy sheet to provide increased transfer electrostatic field to that area in proportion to the remainder of the copy sheet, prior to the copy sheet being effectively neutralized for stripping in the lead edge area by a detacking corona generator. See FIG. 1 and Col. 4, lines 30–60 for a detack corotron power supply and switching the output of the detack corotron.

U.S. Pat. No. 4,791,528 to Suzuki et al. relates to a power supply device capable of supplying high and low voltages for photocopying machines. A switched input voltage is applied to a self excited transformer having two secondary output voltages.

U.S. Pat. No. 4,714,978 to Coleman, assigned to Xerox Corporation, describes a circuit for supplying constant power to A.C. Corotrons. The circuit consists of a pulse width modulator which provides alternate drive signals of adjustable pulse width at a constant frequency; a transformer; a switch pair for separably connecting a common d.c. power source to a transformer primary winding in response to drive signals from the modulator to induce an a.c. output in a transformer secondary winding to a corotron. The secondary winding of the transformer is connected by line to leads of detack and pre-charge corotrons. To provide constant current output to detack and pre-charge corotrons, the operating current of corotrons is monitored using a feedback loop which employs a voltage doubler network consisting of capacitors and diodes for sensing corotron current.

U.S. Pat. No. 4,140,962 to Quinn, assigned to Xerox Corporation, describes an electrical power regulator for a corona discharge device in which a high voltage electrical voltage supply is connected to a corona discharge device having a wire extending in spaced relation relative both to a plate and to a shield which is electrically connected in series with unidirectional current blocking means arranged in mutually opposed polarity to conduct current in opposite directions between the shield and the plate.

Japanese Patent No. 58-184169 to Yamada relates to an electrophotographic device, in which selective switching of modes is facilitated by applying an electric charge to a photoreceptor and charging the photoreceptor with the opposite polarity by a voltage lower than the electric charge to expose an image.

Japanese Patent No. 61-201281 to Tanaka et al. describes a method to prevent specified ions from remaining nearby a photosensitive body by connecting a high plus voltage power source which applies a high plus voltage and a high minus voltage power source which applies a high minus voltage to the discharge wire of a corotron for transfer in parallel, and which applies a voltage of the opposite polarity from toner during transfer operation and a voltage of the same polarity with the toner when transfer operation is not performed.

However, a difficulty with the prior art systems is either the limitation with respect to colors or the need for multiple copy sheet passes through the system and multiple development passes of the photoreceptor to achieve color on the copy sheet. In particular, it is desirable to be able to print images having multiple colors or being limited by the need for multiple passes through the system for successive transfer of different color toners. It would be desirable, therefore, to be able to produce highlight color copies in a single pass of the photoreceptor or other charge retentive surface past the printing process stations.

It is an object, therefore, of the present invention to provide a new and improved system for providing multiple colors in a single pass of the copy sheet through a transfer station. Another object of the present invention is to provide a reliable, less complicated switching mechanism for automatically adjusting the polarities and potentials of transfer and detac corotrons in response to optionally selected colors in a single pass machine. Another object of the present invention is to provide multiple colors in a single pass color machine by automatically altering a corona generating device polarity in response to selected colors. Another object of the present invention is to automatically respond to operator selection of a particular color by switching the polarity of a transfer corotron and automatically adjusting the output of the detac corona device. Other advantages of the present invention will become apparent as the following description proceeds, and the features characterizing the invention will be pointed out with particularity in the claims annexed to and forming a part of this specification.

SUMMARY OF THE INVENTION

The present invention is concerned with a system for providing multiple colors in a single pass of a copy sheet through a transfer station by switching the polarity of a transfer corotron and automatically adjusting the output of the detac corona device. In particular, a single power supply including high voltage switches responds to color selections to change the polarity of a transfer corotron to charge a copy sheet for toner transfer, and a current sense and precision rectifier stage responds to the copy sheet charge to provide a suitable detac charge independent of the transfer corotron polarity.

For a better understanding of the present invention, reference may be had to the accompanying drawings wherein the same reference numerals have been applied to like parts and wherein:

DETAILED DESCRIPTION OF THE PREFERRED EMBODIMENT OF THE INVENTION

Figure 1:
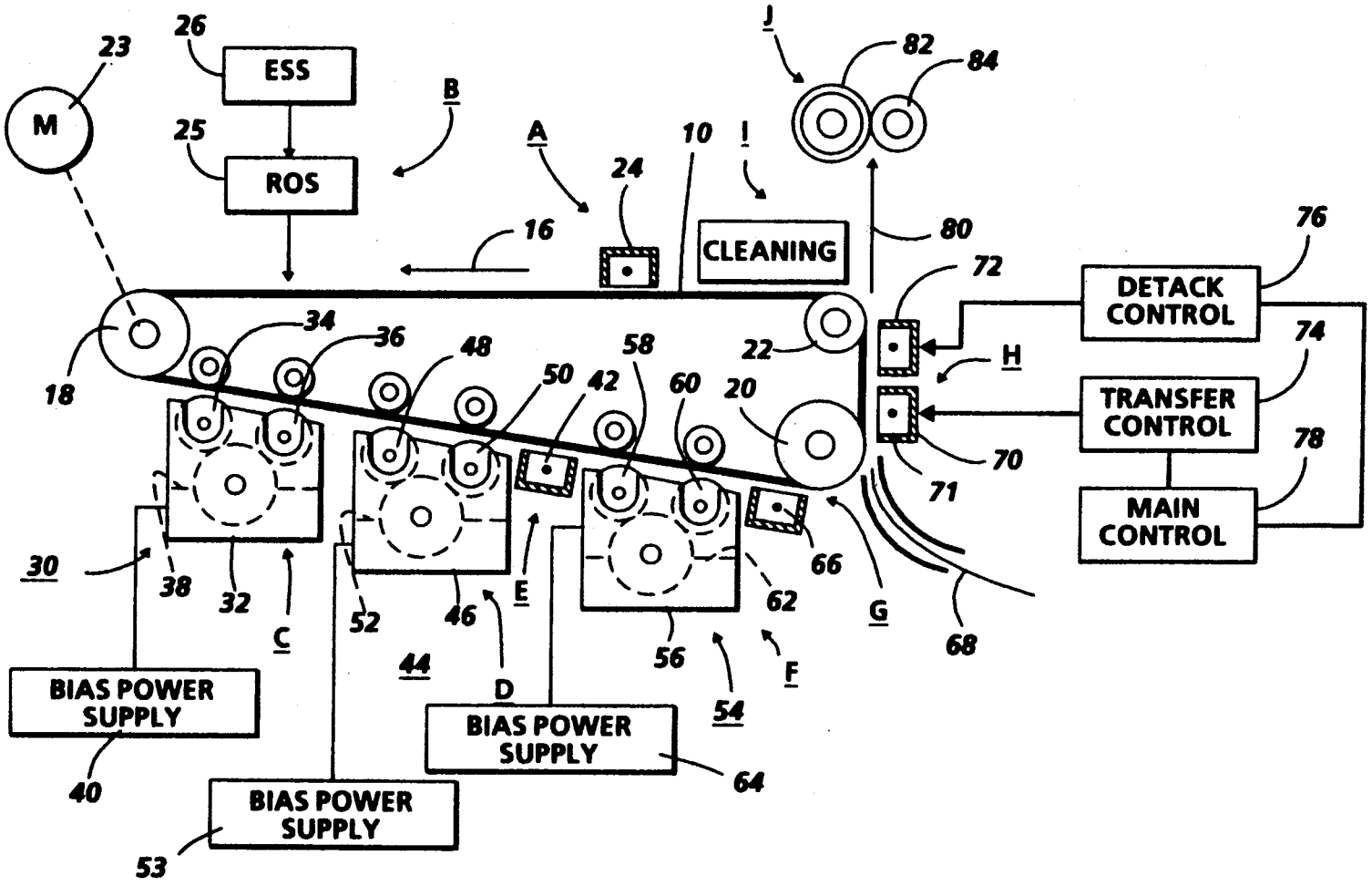
FIG. 1 is a schematic illustration of an imaging apparatus incorporating the inventive features of the invention.

As shown in FIG. 1, a typical printing machine incorporating the invention may utilize a charge retentive member in the form of a photoconductive belt 10 consisting of a photoconductive surface and an electrically conductive substrate and mounted for movement past a charging station A, an exposure station B, a first development station C, a second development station D, a uniform exposure station E, a third development station F a pre-transfer charging station G, a transfer and detac station H, and a cleaning station I. It should be noted that although the system has been described with respect to three development stations the invention is applicable to systems with a different number of development stations such as two development stations. Belt 10 moves in the direction of arrow 16 to advance successive portions thereof sequentially through the various processing stations disposed about the path of movement thereof for forming images in a single pass of the belt through all of the process stations. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16.

As can be seen by further reference to FIG. 1, initially successive portions of belt 10 pass through charging station A. At charging station A, a corona discharge device 24 charges the belt 10 to a selectively high (i.e. 1000 volts) uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to remain charged or to be discharged in accordance with the output from the scanning device. Preferably the scanning device is a four-level (2 bit) Raster Output Scanner (ROS). An Electronic Sub-System (ESS) 26 converts a previously stored image into the appropriate control signals for the ROS in an imagewise fashion. Such exposure results in a photoreceptor containing four-level images equal to −1000 ($V_{ddp}$), −775 ($V_1$), −480 ($V_2$) and −100 ($V_{residual}$) volts by way of example. The four voltage levels correspond to three image areas and a background area. Three development apparatuses 30, 44 and 54 are provided for developing the three image areas with different color toners.

The −1000, $V_{ddp}$ volt level results from the ROS being turned off at that region of the photoreceptor so no exposure and discharge occurs there. The −100 volt region received maximum exposure by the ROS so the photoconductor discharges to its residual voltage ($V_{residual}$). Intermediate voltage levels are obtained by using the ROS intermediate power levels.

The next step is development of two of the voltage levels with, for example, negatively charged black toner and positively charged red toner. For developing the −1000 volt image level, electrical bias for a red developer housing 32 forming a part of conductive magnetic brush developer apparatus 30, is set to −850V and Charged Area Development is used. This provides −150 volts for the development field and at least −75 volts as the cleaning field for effecting development of such images with red toner forming a part of a two component developer 38, the cleaning field serving to preclude development of background areas. The red toner is applied to the latent electrostatic images contained on the photoconductive surface 10 via magnetic brush rollers 34 and 36, the carrier of this two component developer 38 being selected such that the red toner is positively charged through triboelectric charging thereagainst.

Setting the bias of a black developer housing 46 of conductive magnetic brush developer apparatus 44 to −410 volts and using Discharge Area Development provides a −310 volt development field and a −70 volt cleaning field for effecting development of $V_{residual}$ with negatively charged black toner forming part of a two component developer 42. Deposition of the black toner is effected via magnetic brush rollers 48 and 50.

Next, a non-imaging uniform exposure is applied to the photoconductor with a well controlled light source such as a fluorescent lamp 42. The amount of exposure applied is sufficient to discharge the −480 volt region of the photoconductor to −240 volts. The −775 volt region will discharge to −410 volts. The areas of the photoconductor that have already been developed with red and black toners, are shielded from the light by the deposited toner, so, little or no discharge occurs in these areas. This is especially true in the black (very opaque) toner region where maintaining roughly a −410 volt level is important to achieve a sufficient cleaning field in the next development step. If necessary, the absorption spectra of the toners could be matched to the emission spectrum of the lamp to fully insure that discharge beneath the toner does not take place.

The final stage of development uses another colored toner, say blue, and Discharge Area Development with a bias level of −340 volts. The blue toner forms part of a two component developer 62 contained in conductive magnetic developer housing 56 of developer apparatus 54. The development and cleaning fields will be −100 volts and −70 volts respectively. The negatively charged blue toner is deposited on the blue image areas represented by voltage, $V_2$ utilizing magnetic brush rollers 58 and 60.

Because the composite image developed on the photoreceptor consists of both positive and negative toner, a typically positive pre-transfer corona discharge member 66 disposed at pre-transfer charging station G is provided to condition the toner for effective transfer to a substrate using positive corona discharge.

A sheet of support material 68 is moved into contact with the toner image at transfer and detac station H for transfer of the developed image onto a sheet of support material during one pass of the sheet of support material through the transfer and detac station H. The sheet of support material is advanced to transfer and detac station H by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D. The copy sheet first passes under a not shown biased transfer roll, transfer assist blade, or any other suitable device pressing the copy sheet into positive engagement with the surface of the photoreceptor.

Transfer and detac station H includes a transfer corona generating device 70 which sprays ions of a suitable polarity onto the backside of sheet 68. This attracts the charged toner powder images from the belt 10 to sheet 68. The transfer corona generating device 70 is connected to a suitable high voltage transfer control 74 in turn interconnected to main control 78 for the generation of electrostatic transfer fields between the photoreceptor and the copy sheet for optimum transfer of the toner. After passing under the transfer corona generating device 70, the copy sheet passes under a detac corona generating device 72 to enable the stripping of the copy sheet from the curved surface of the photoreceptor.

The detac corona generating device 72 is connected to detac control 76 which in turn is xerographically connected to high voltage transfer control 74. The detac control 76 and detac corona generating device 72 provide suitable corona emissions to neutralize, at least partially, the transfer charges which were deposited on the copy sheet by the transfer corona generating device 70 to assist in stripping the lead edge of the copy sheet from the photoreceptor. As is well known in the art if the electrostatic transfer charges on the copy sheet were not neutralized, they would generate forces electrostatically resisting the stripping of the copy sheet from its support surface. After transfer, the sheet continues to move, in the direction of arrow 80, onto a conveyor (not shown) which advances the sheet to fusing station J.

Fusing station J includes a fuser assembly which permanently affixes the transferred powder image to sheet 68. Preferably, the fuser assembly comprises a heated fuser roller 82 and a backup roller 84. Sheet 68 passes between fuser roller 82 and backup roller 84 with the toner powder image contacting fuser roller 82. In this manner, the toner powder image is permanently affixed to sheet 68. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I. A magnetic brush cleaner housing is disposed at the cleaner station I. Subsequent to cleaning, a discharge lamp (not shown) floods the photoconductive surface with light to dissipate any residual electrostatic charge remaining prior to the charging thereof for the successive imaging cycle.

For further details of the above described system, reference is hereby made to, U.S. Pat. No. 07/736,375 incorporated herein.

In accordance with the present invention, the transfer device 70 and detac device 72 outputs switch polarity in response to a digital command provided by main control 78.

Figure 2:
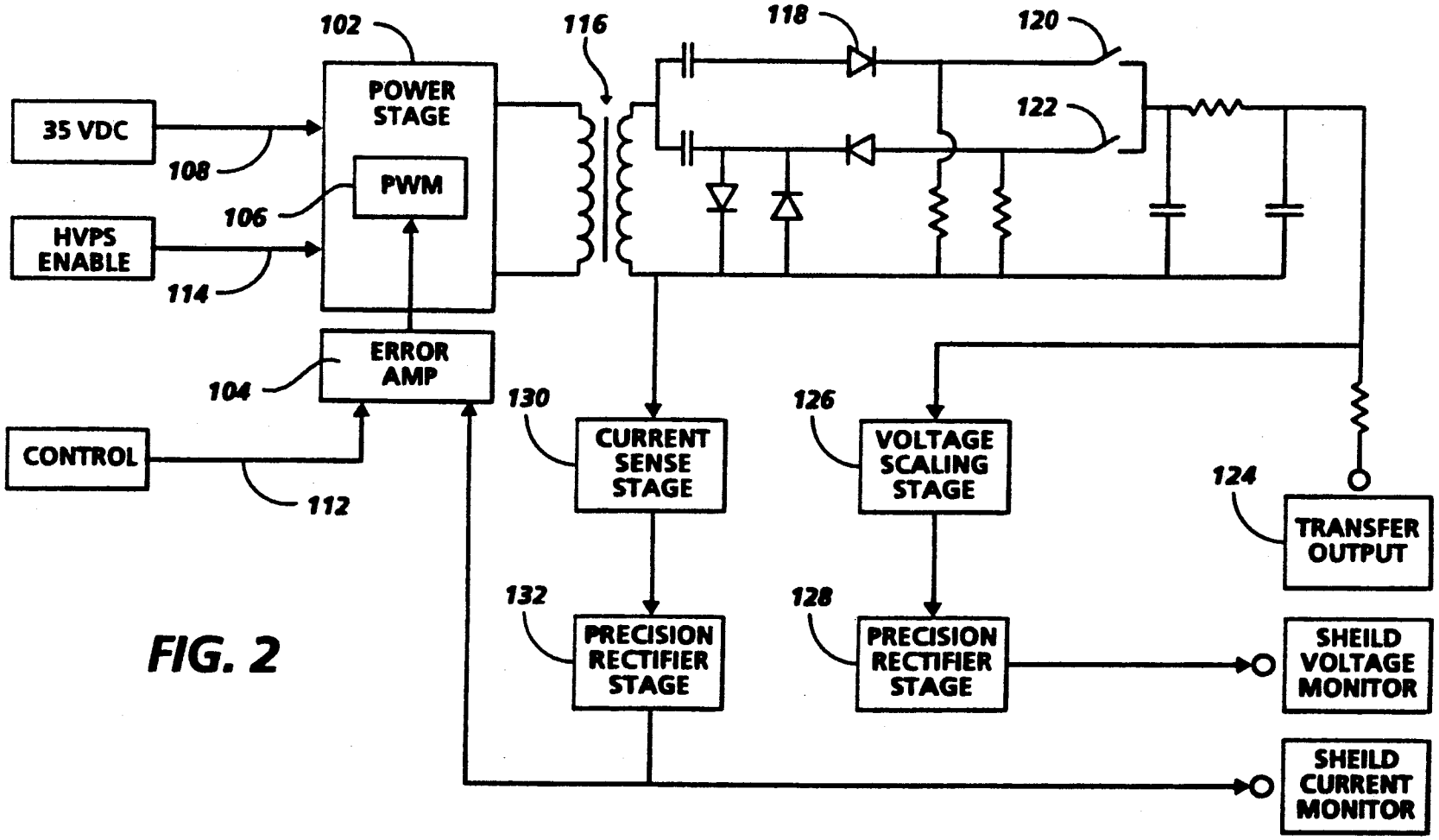
FIG. 2 is a block diagram of the transfer corona generating device control in accordance with the present invention.

The Transfer control 74, shown in FIG. 2, includes a power stage 102 having Pulse Width Modulator (PWM) circuitry 106. The power stage, a conventional half bridge, series resonant switched mode topoloy, converts the 35 VDC for power shown at 108 into a 24 Khz sine wave. An error amplifier 104 compares the scaled output parameter (for transfer it is the shield current signal 132 of the shield 71 of corona generating device 70 with the control signal 112. This control signal 112 is a unipolar analog (0 to 10 volt) signal from the main control 78 used to set the shield current to a desired value. The output of the error amplifier 104 is converted into a PWM (Pulse Width Modulation) signal by PWM 106 which drives the power stage 102. A HVPS enable signal 114 is provided to turn the system on and off by an enable signal from the main control 78.

The level of the 24 khz sine wave (and hence the level of the output parameter) is determined by the PWM signal 106 A. A HV transformer 116, steps up the voltage level where it is further increased by a conventional voltage doubler generally shown at 118. Suitable relay controlled switches 120, 122 connect the appropriate doubler to the transfer output 124. It should be understood that the high voltage relay controlled switches 120, 122 could be Field Effect Transistors or any other suitable high voltage switch.

Reliability is improved by "cold switching" the High Voltage relays. This means that the main control removes the HVPS Enable signal 114 some time (about 300 milliseconds) before it changes the state of the relays (controlling switches 120 and 122) with a Polarity Select command from control 78. The output voltage is reduced to the desired analog voltage level by the voltage scaling stage 126. The output of the voltage scaling stage 126 is bipolar (dependent upon the output polarity) and hence is not satisfactory for the system control (which requires a unipolar monitor signal). The precision rectifier 128 provides this interface, and is a unity gain buffer for signals above 0 VDC and a unity gain invertor for signals below 0 VDC. The output of the precision rectifier 128 is fed to the main control 78, allowing it to monitor the shield voltage of the transfer corotron 70. The output current is converted to a voltage signal and appropriately scaled by a current sense stage 130. Similar to the voltage scaling stage, it has a bipolar output and also is followed by a precision rectifier stage 132. This scaled, absolute value form of the shield current is fed to the power stage 102. It is then compared to the unipolar control signal to complete the transfer control loop. The unipolar shield current signal is also fed to the system control, allowing it to monitor the shield current.

Figure 3:
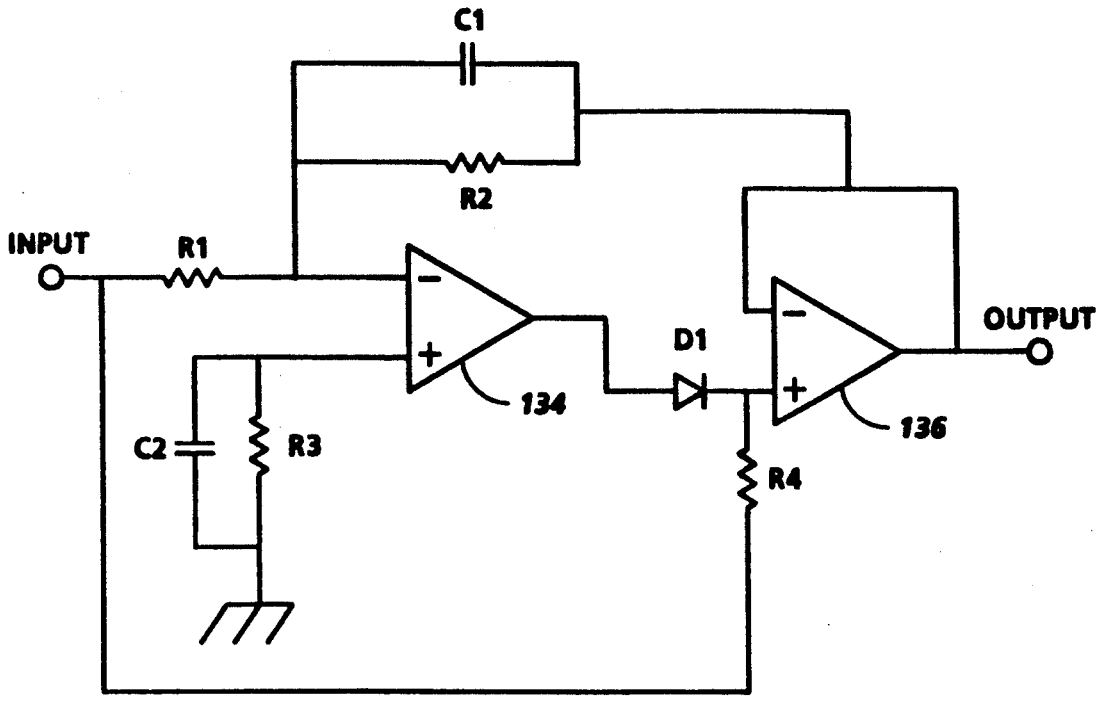
FIG. 3 is a schematic of the precision rectifier circuit shown in FIG. 2.

The precision rectifier circuits, 128 and 132 as shown in FIG. 3, also called an absolute value detector, provides a unipolar output from a bipolar input. This circuit allows the low level analog control loop to switch automatically when the output polarity is switched by the HV relays. System control is given unipolar monitor signals, regardless of the output polarity. If the input is less than 0 VDC, it is inverted by invertor stage 134. The output of inverter stage 134 is applied to a unity gain buffer 136. The output of buffer 136 is the output of the precision rectifier stage. Resistors R1 and R2 form the conventional Operational Amplifier feedback and gain setting network. This network eliminates the cross over distortion which occurs near 0 volts, due to the diode drop of D1. Conversely, if the input is greater than 0 VDC, it appears as a negative signal at the output of inverter stage 134. Diode D1 blocks the signal from reaching the input of buffer 136. The positive input signal is fed to buffer 136 input via R4. Hence, a positive signal appears at the output. The shield current from the current sense stage 132; and the shield voltage signal from the voltage scaling stage 128 have a high 4 kz component and this AC alternating current component causes an offset between the inverting and non-inverting modes. Capacitors C1 and C2 mitigate the effect of the AC.

Figure 4:
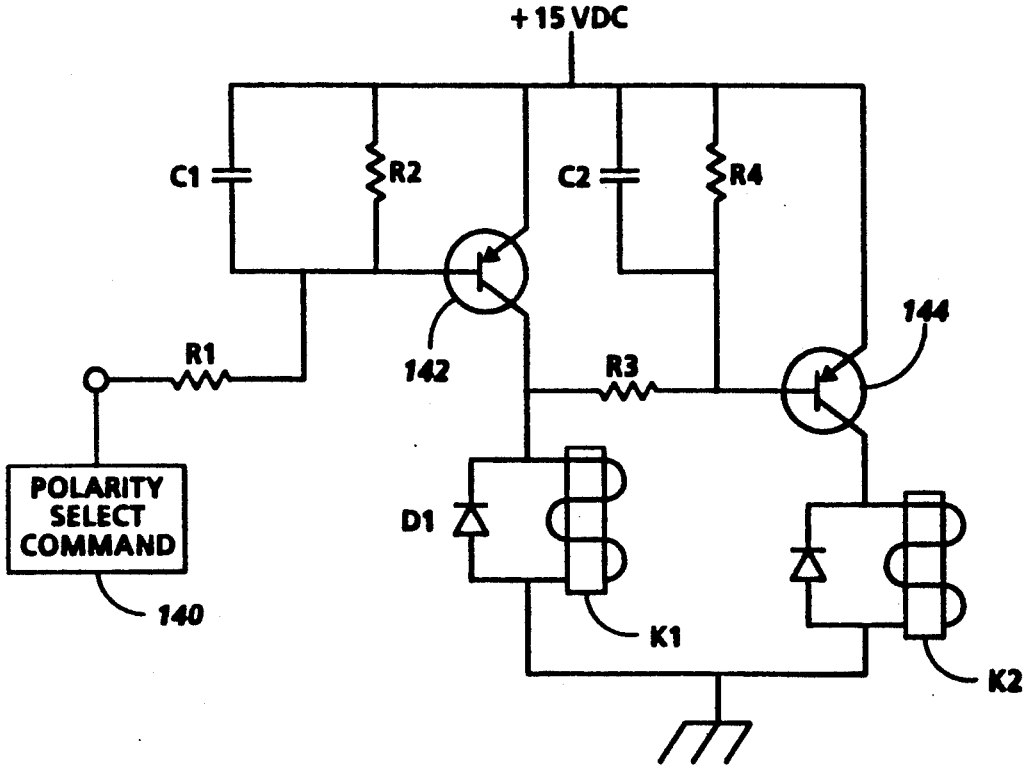
FIG. 4 is a schematic of the relay coil driver for switches 120 and 122 shown in FIG. 2.

FIG. 4 is the schematic of the HV relay coil driver. It receives the digital Polarity Select command 140 from main control 78. This command 140 is from an open collector driver. A high (or open) calls for positive transfer shield current, whereas, a low (or short) calls for negative transfer shield current. The low turns on transister 142 via R1. Transister 142 in turn energies relay coil K1 (closes K1 contacts) while turning off transister 144. With transister 144 off, relay K2 is in the open state. Conversely, with the command in the high state, transister 142 is held off by R2. The voltage across K1 coil collapses (opening K1 contacts). With no voltage across K1 coil, transister 144 is turned on via R3. Transister 144 then energizes K2 coil (closing K2 contacts). The delay provided by system control from a HVPS disable signal assures no problem with contact bounce. It is standard practice to use diodes D1 and D2 for suppression of the inductive fly back from the relay coils. Resistors R2 and R4, along with capacitors C1 and C2, prevent false tripping of transistors 142, 144 by the high noise in the machine environment.

Figure 5:
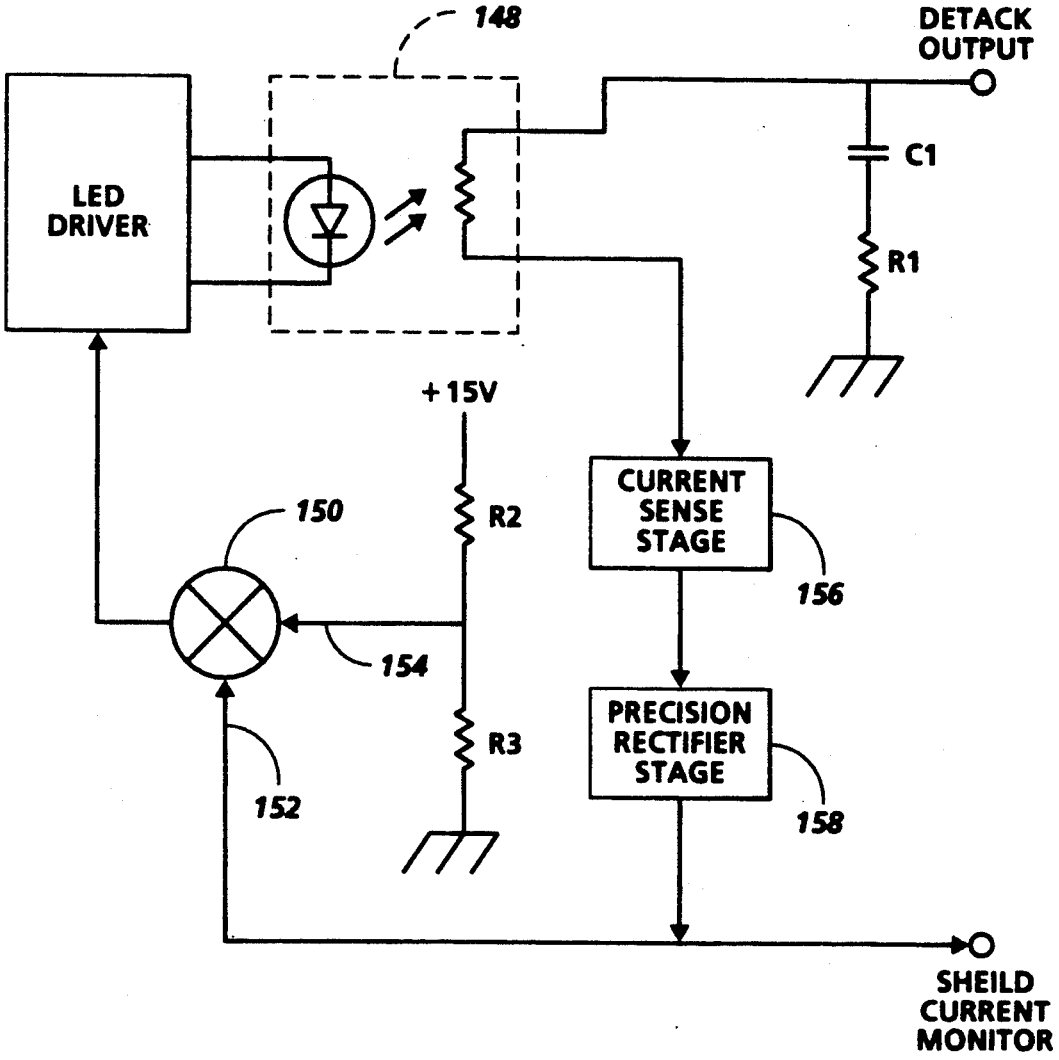
FIG. 5 is a block diagram of the detac corona generating device control in accordance with the present invention.

A block diagram for the Detac Control 76 is shown in FIG. 5. Basically, Detac is a constant current sink, the power coming from the dicorotron shield. The shield is connected to ground via the resistive portion of the LED/LDR (Light Emitting Diode/Light Dependent Resistor 148). It should be understood that the LED/LDR combination could be replaced by Field Effect Transistors or any other suitable high voltage control element. The value of this resistor is controlled by the current in the LED. R1 and C1 serve to bypass the AC component of the shield current. The LED current is an amplified form of the error amplifier 150 output. The error amplifier 150 generates an error signal from the difference between the shield current signal illustrated at 152 and a reference voltage 154 established by the R2, R3 circuit.

The shield current is translated and scaled into a voltage signal by the current sense stage 156 and depending on the mode of the machine, the polarity of the shield current is either positive or negative. Hence, the output of the current sense stage 156 is bipolar. As in the case of the Transfer Control 74, the current sense stage 150 is followed by a precision rectifier circuit 158. Fortunately, the LDR is a bipolar device (similar to a resistor) and performs the same with either polarity of shield current. Therefore, the Detac Control 76 automatically accommodates either polarity of shield current applied to it, due to the addition of the precision rectifier circuit.

What is claimed is:

1. In an electrostatographic copying apparatus having a plurality of-color modes of operation and in which imaging material is transferred from an image support surface to a moving copy member by electrical transfer means including an electrical power supply, which transfer means applies electrostatic fields for said transfer of the imaging material and deposits electrostatic charges on the copy member of a given polarity which electrostatically resist the stripping of the copy member from said image support surface; and in which copying apparatus detacking corona generating means are also provided for at least partially neutralizing said charges deposited on the copy member by said transfer so as to assist in the stripping of the lead edge of the copy member from said image support surface; the imaging material being a plurality of toner colors, the plurality of toner colors being transferred to the moving copy member in a single pass through the transfer means; the improvement comprising transfer switching means responsive to the mode of operation for changing the polarity of the electrostatographic charges deposited on the copy member.

2. The apparatus of claim 1 wherein the switching means includes high voltage relays.

3. The apparatus of claim 1 wherein the switching means are Field Effect Transistors.

4. The apparatus of claim 1 wherein the transfer means includes a high voltage corona generating device and wherein the switching means are switched at low voltage levels.

5. A system for transferring a plurality of selected toner colors to a copy sheet in a single pass of the copy sheet through a transfer station comprising:

means to select predetermined toner colors, a transfer corotron for charging the underside of the copy sheet for toner transfer, a high voltage power supply electrically connected to the transfer corotron and responsive to selected toner colors to switch the polarity of the charge provided on the copy sheet by the transfer corotron, a detac corona device for neutralizing the charge on the copy sheet after toner transfer, and a current sense and precision rectifier electrically connected to the detac corona device and responding to the copy sheet charge to provide a suitable detac charge independent of the transfer corotron polarity.

6. The system of claim 5 wherein the high voltage power supply includes high voltage switch relays to change the polarity of the transfer corotron.

7. The system of claim 5 wherein the high voltage power supply includes Field Effect Transistors to change the polority of the transfer corotron.

8. A system for transferring a plurality of selected toner colors to a copy sheet in a single pass of the copy sheet through a transfer station comprising:

means to select predetermined toner colors, a transfer corotron for charging the underside of the copy sheet for toner transfer, a high voltage power supply electrically connected to the transfer corotron and responsive to selected toner colors to switch the polarity of the charge provided on the copy sheet by the transfer corotron, and a detac corona device responding to the copy sheet charge for neutralizing the charge on the copy sheet after toner transfer.

9. The system of claim 8 including a current sense and precision rectifier electrically connected to the detac corona device to provide a suitable detac charge independent of the transfer corotron polarity.

* * * * *